US007507072B2

(12) United States Patent
Bart

(10) Patent No.: US 7,507,072 B2
(45) Date of Patent: Mar. 24, 2009

(54) TURBINE MODULE FOR A GAS-TURBINE ENGINE WITH ROTOR THAT INCLUDES A MONOBLOCK BODY

(75) Inventor: Jacques Rene Bart, Verrieres le Buisson (FR)

(73) Assignee: SNECMA, Paris (FR)

( * ) Notice: Subject to any disclaimer, the term of this patent is extended or adjusted under 35 U.S.C. 154(b) by 484 days.

(21) Appl. No.: 11/229,676

(22) Filed: Sep. 20, 2005

(65) Prior Publication Data

US 2006/0251520 A1 Nov. 9, 2006

(30) Foreign Application Priority Data

Sep. 21, 2004 (FR) ..... 04 52102

(51) Int. Cl.
*F01D 5/06* (2006.01)

(52) U.S. Cl. ..... 416/198 A

(58) Field of Classification Search ..... 415/208.2, 415/209.1, 209.2, 209.3, 216.1; 416/244 A, 416/244 R, 198 A See application file for complete search history.

(56) References Cited

U.S. PATENT DOCUMENTS

| | | | | |
|---|---|---|---|---|
| 3,644,057 | A | 2/1972 | Steinbarger | |
| 3,963,368 | A | 6/1976 | Emmerson | |
| 4,483,054 | A * | 11/1984 | Ledwith | 29/889.2 |
| 4,730,982 | A * | 3/1988 | Kervistin | 416/95 |
| 5,131,811 | A | 7/1992 | Johnson | |
| 5,320,487 | A | 6/1994 | Walker et al. | |
| 5,350,278 | A | 9/1994 | Burge | |
| 5,470,524 | A | 11/1995 | Krueger et al. | |
| 5,503,528 | A | 4/1996 | Glezer et al. | |
| 5,616,003 | A | 4/1997 | Charbonnel et al. | |
| 6,655,920 | B2 * | 12/2003 | Beutin et al. | 416/198 A |
| 2002/0187046 | A1 | 12/2002 | Beutin et al. | |
| 2003/0206799 | A1 | 11/2003 | Scott | |
| 2005/0025625 | A1 | 2/2005 | Escure et al. | |
| 2005/0238490 | A1 | 10/2005 | Humhauser | |
| 2006/0251520 | A1 | 11/2006 | Bart | |
| 2007/0231133 | A1 | 10/2007 | Bart | |

FOREIGN PATENT DOCUMENTS

| | | | |
|---|---|---|---|
| EP | 0 704 601 | A1 | 4/1996 |
| WO | WO 03/102379 | A1 | 12/2003 |

* cited by examiner

*Primary Examiner*—Edward Look
*Assistant Examiner*—Nathaniel Wiehe
(74) *Attorney, Agent, or Firm*—Oblon, Spivak, McClelland, Maier & Neustadt, P.C.

(57) ABSTRACT

A turbine module for a gas-turbine engine with a turbine rotor includes four disks at least supporting blades at their periphery. Two of the disks form a monoblock body. The monoblock body includes two lateral inter-disk ferrules, the ferrules being bolted on the disks of the two rotors adjacent to the monoblock body.

14 Claims, 4 Drawing Sheets

TURBINE MODULE FOR A GAS-TURBINE ENGINE WITH ROTOR THAT INCLUDES A MONOBLOCK BODY

This present invention relates to the area of gas-turbine engines, and in particular deals with a modular turbine element for such an engine, including a monoblock turbine module.

A gas-turbine engine includes, in the direction of flow of the gases, the means for compressing the air feeding the engine, a combustion chamber, and at least one turbine stage to drive the air compression resources. In the aeronautical area, the engine can drive a fan that contributes to the thrust produced by the latter. The air admitted to the intake of the engine is then divided into a primary stream routed to the combustion chamber and a secondary stream, concentric to the first, and supplying the major part of the thrust in engines with a high dilution rate. In some cases, such engines include two bodies—a high-pressure body and a low-pressure body—which are independent in rotation from each other. The low-pressure body drives the fan. Each body includes a turbine module driving the associated compression module.

FIG. 1 shows, in longitudinal section, the low-pressure turbine module of a double-bodied engine according to existing designs. The remainder of the engine is not visible in this figure. This module is placed downstream of the high-pressure stage whose flow of gas feeds out via the distributor 3 composed of blades that are fixed, individual or in sectors, mounted between the outer casing 5 and the fixed internal structure 7. The low-pressure turbine rotor 9 is composed of five disks 9A to 9E equipped with blades on their periphery and bolted together. The five stages are separated by fixed flow distributors, 11A to 11D, which each rectify the flow of gas emerging from the upstream stage for the stage located immediately downstream.

The disks are each edged laterally by a tapered part 10 fitted with radial brackets, called a "moustache", by which they are bolted to the neighbouring disk. The blades 12 are 30 encased in axial sockets with a dovetail profile, and held against all axial movement by a hook 12' fitted to their root. An annular circlip 13 is engaged under each of the hooks and forms an axial lock on the blades. The retaining circlip 13 itself is held in place and immobilised against all radial movement which could disengage it from the hooks 12' by inter-stage rings 14. These rings 14, which are equipped with sealing lips, form a labyrinth gasket with abradable plates mounted along the inside edges of the distributors. These also guide the cooling air from the inside of the rotor to the blade roots. Radial passages are provided for this purpose.

The mounting of this turbine module is complex because of the number of parts involved in its structure.

It would therefore be desirable to create a module whose structure would result in easier assembly.

Indeed, it would be desirable to create a module in which the number of parts would be reduced, thus allowing easier mounting and simpler parts management.

It would also be desirable to reduce the mass of the parts constituting the rotor.

And again, it would be desirable to reduce to a minimum the structural modifications to the turbine module according to the existing designs presented above, in order not to give rise to significant development.

The applicant has therefore set as an objective the creation of a turbine module, and more particularly of a low-pressure turbine module, whose structure is simplified in relation to the implementation of previous designs.

The applicant is the holder of patent application EP 1 264 964, which concerns an arrangement for a turbomachine rotor that includes two disks with the blades housed in axial sockets. The two disks are welded so as to former a monoblock body. A spacer is fitted between the two disks to form a labyrinth sealing element and to guide the cooling air. In particular it includes an annular part enveloping, at a distance, the surface of the rotor, in the form of a shell, between the two disks, as well as tongues that are capable of sliding in the sockets. This monoblock body solution has a structure that is simplified in relation to an assembly of two disks bolted together. Moreover, there is the advantage of a saving of mass. However this structure involves constraints on the arrangement of the blades which are not necessarily favourable from an aerodynamic viewpoint.

We are familiar with U.S. Pat. No. 5,899,660, which concerns a casing that allows the creation of turbine modules whose structure is simplified. The distributors form a single part with the sealing rings of the turbine rotors. The parts of the different stages are bolted together so that together they form a casing. However such a solution would involve a substantial modification of the structure of previous designs.

We are also familiar with U.S. Pat. No. 4,248,569 which concerns a stator mounting whose sealing ring forms a single part with the distributor, and that allows control of the play between the sealing ring and the tip of the rotor blades of the turbine. The number of parts is therefore reduced. However, it does not appear that the solution presented would be applicable easily to a turbine module with several stages.

The objective of the invention is therefore to create a turbine module whose structure is simplified without presenting the drawbacks of the solutions presented in previous designs.

According to the invention, the turbine module for a turbine engine with a turbine rotor composed of four disks at least, supporting blades around their periphery, where two of the said disks form a monoblock body, is characterised by the fact that the said monoblock body includes two lateral inter-disk ferrules, where the said ferrules are bolted onto the disks of the two adjacent rotors.

In relation to the module of previous design presented above, the structure according to the invention firstly allows a reduction in the mass of the rotary assembly in particular by eliminating part of the bolted connecting devices, and by lightening the adjacent disks by removal of the moustaches, and also allows the structure of the module to be simplified.

According to another characteristic, the rotary assembly of the turbine module includes inter-stage rings that include sealing lips for a labyrinth gasket between each of the said adjacent disks and the monoblock body. Advantageously the said rings also form an axial locking resource for the blades and/or a passage for the cooling air with the said inter-disk ferrules. Thus, to the extent that these inter-stage rings are placed on the end ferrules of the monoblock body, their mounting requires no particular arrangement of the blades mounted on the disks. Moreover, the circulation of the cooling air is guaranteed for all four-blade stages.

According to a particular and preferred method of implementation presenting an improved simplified structure, the module includes one or more annular distributors composed of a variety of elements in the form of a ring sector in which a first part supports fixed blades located radially to the axis of the turbine, and a second part forms a sealing resource with the tips of the mobile blades. Preferably, the said elements in the form of ring sectors are held inside the casing by attachment resources.

According to another characteristic, the said attachment resources include an axial hook attached to the casing or to the said elements, that fits together with a pair of axial hooks attached respectively to the said elements or the casing. Preferably, the pair of hooks is placed on the upstream part of the said elements in the form of ring sectors.

Advantageously, the attachment resource includes an axial hook on the casing, which engages with a pair of axial hooks attached to the said elements in the form of ring sectors, in such a way that the downstream end of the sealing ring sectors of the rotor placed upstream are held between the hooks.

By virtue of the solution of the invention, mounting of the turbine stages is effected in a simple and efficient manner without the need for substantial modification of the environment of this module in the engine.

One non-limiting method of implementation of the invention will now be described with reference to the appended drawings, in which.

Figure 1:
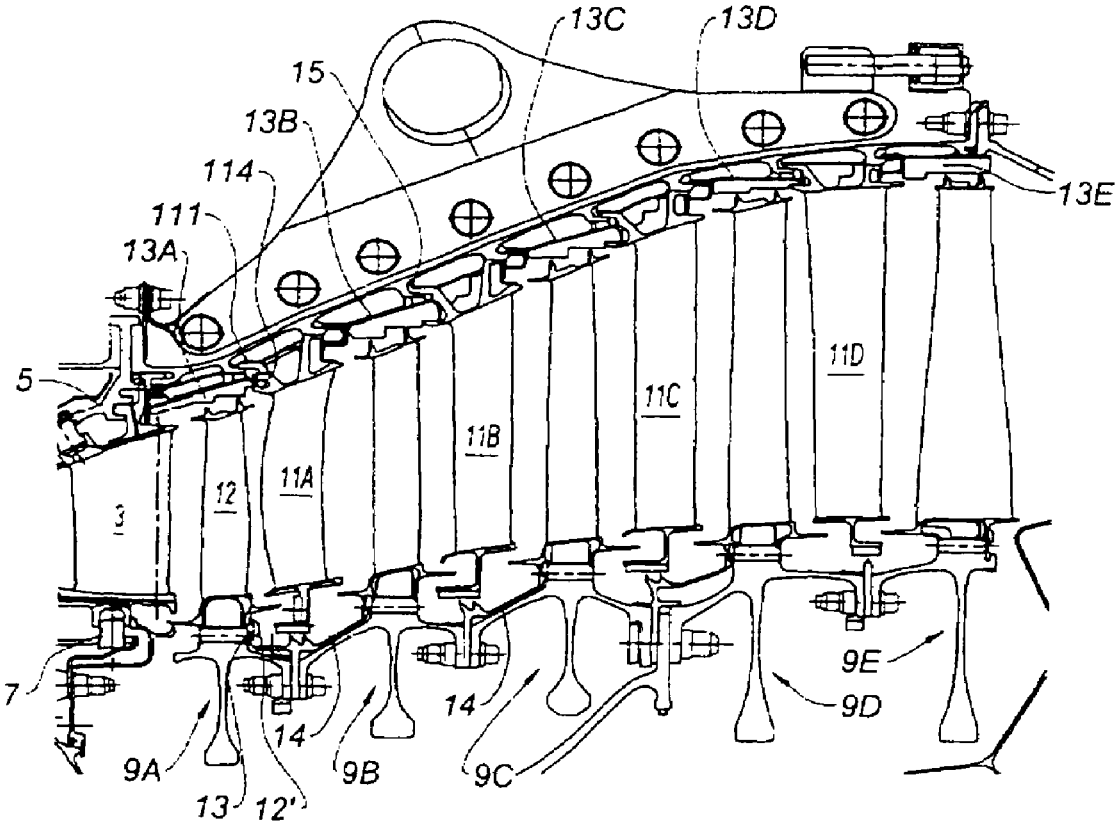
Fig. 1 PRIOR ART
FIG. 1 shows a turbine module of a gas-turbine engine according to existing designs.
Figure 2:
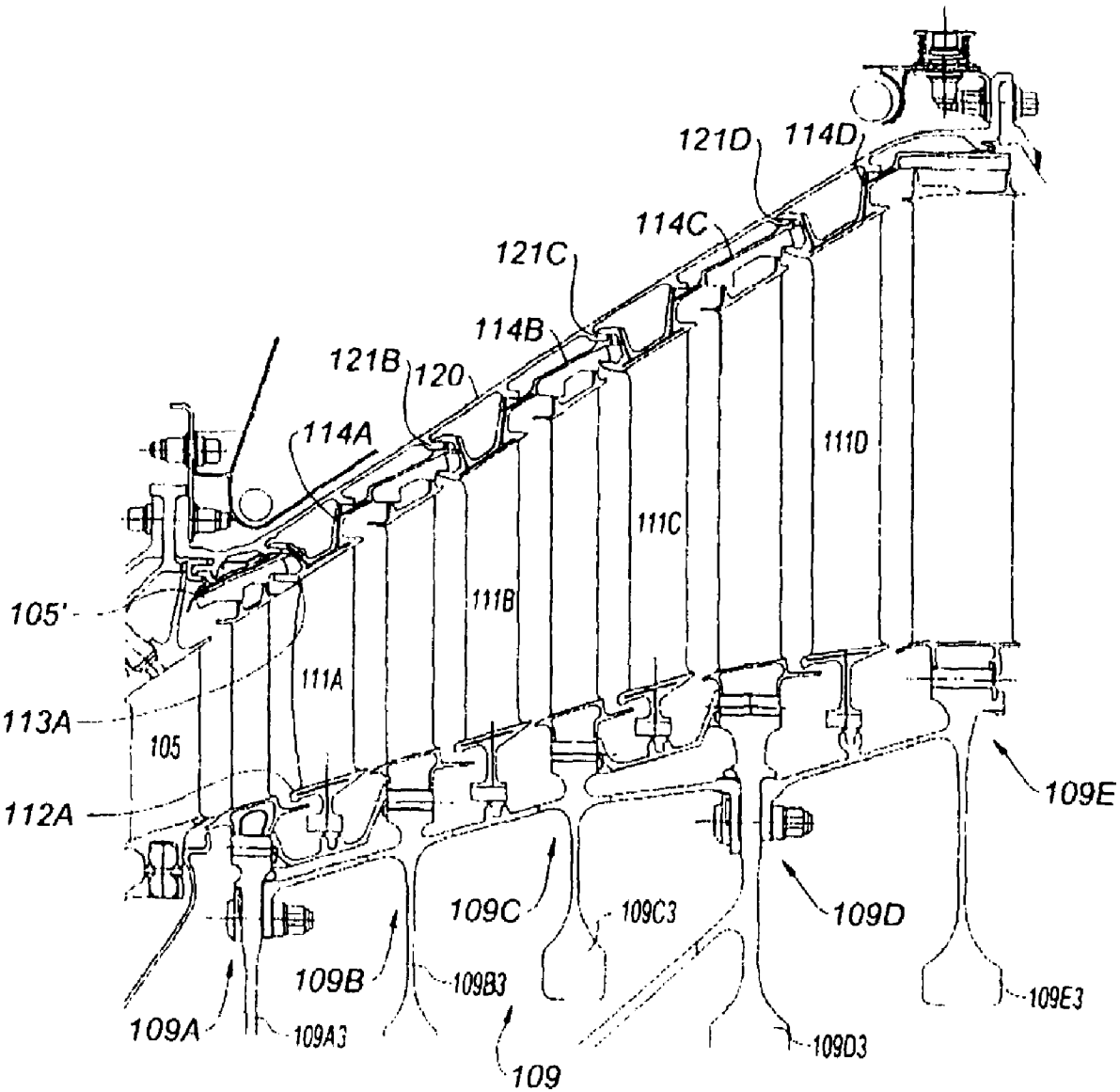
FIG. 2 shows the module according to the invention.

The module according to the invention shown in section along the axis of the gas-turbine engine, is placed downstream of the combustion chamber, not visible in FIG. 2. It receives the stream of engine gases via the distributor 105. It includes a casing of general tapered shape 120 within which are mounted the different distributor stages located between the turbine rotor stages. As in the device of previous design presented with reference to FIG. 1, here the module includes five turbine stages 109A to 109E between which four distributors rings 111A to 111D are located.

Figure 3:
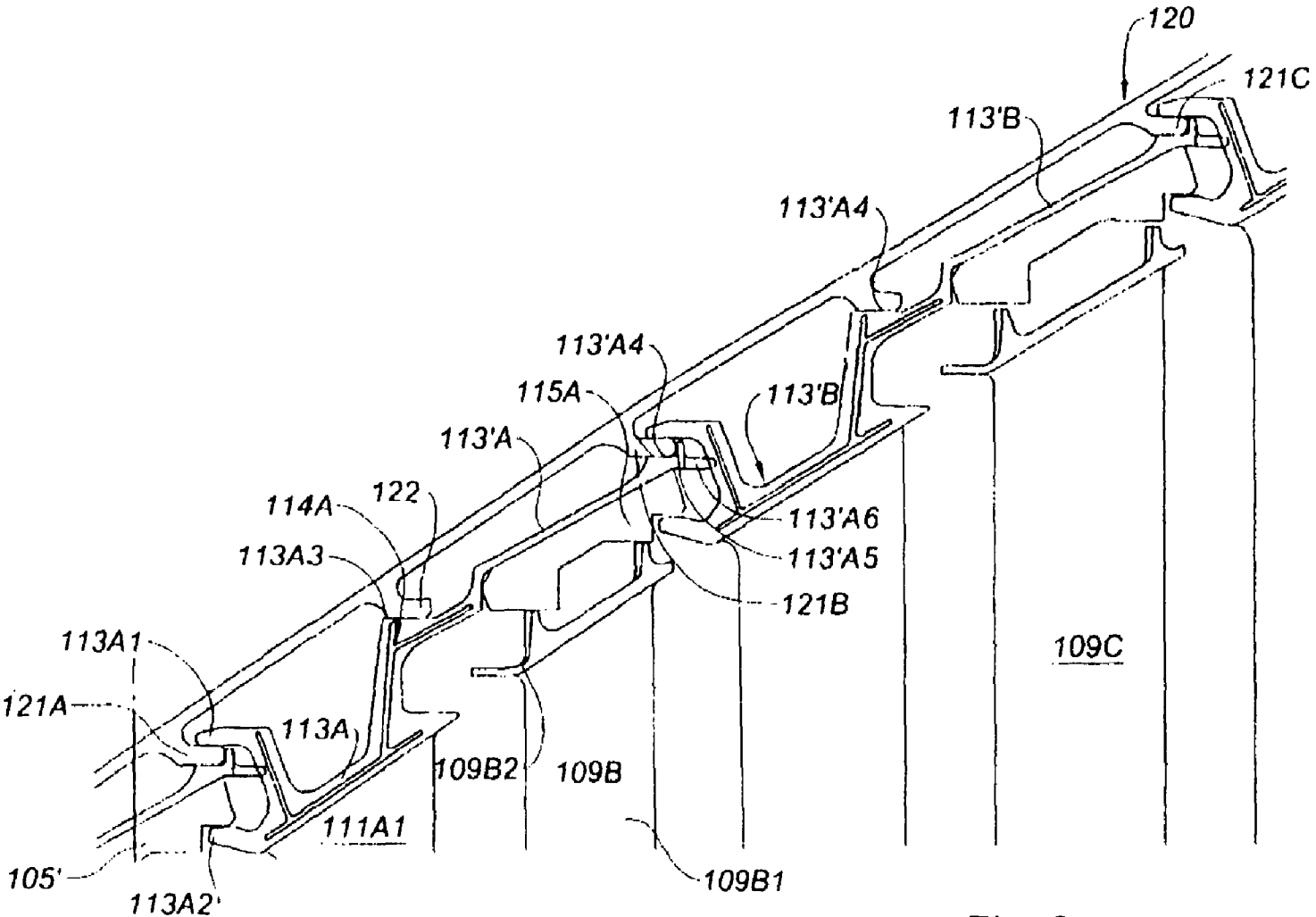
FIG. 3 shows an enlarged part of the stator of the module of FIG. 2

Distributor 111A is of generally annular shape, being subdivided into sectors. The sectors include from one to some ten fixed blades, possibly five or six for example. As an example, there may be 8 sectors forming the distribution ring. In the case of each sector of distributor 111A, one can distinguish (see FIG. 3 also for greater detail) the vane or vanes 111A1 located radially through the gas stream between an internal platform 112A located alongside the axis of the engine and an external platform 113A opposite. Distributors 111B to 111D are preferably made up in the same way.

Figure 4:
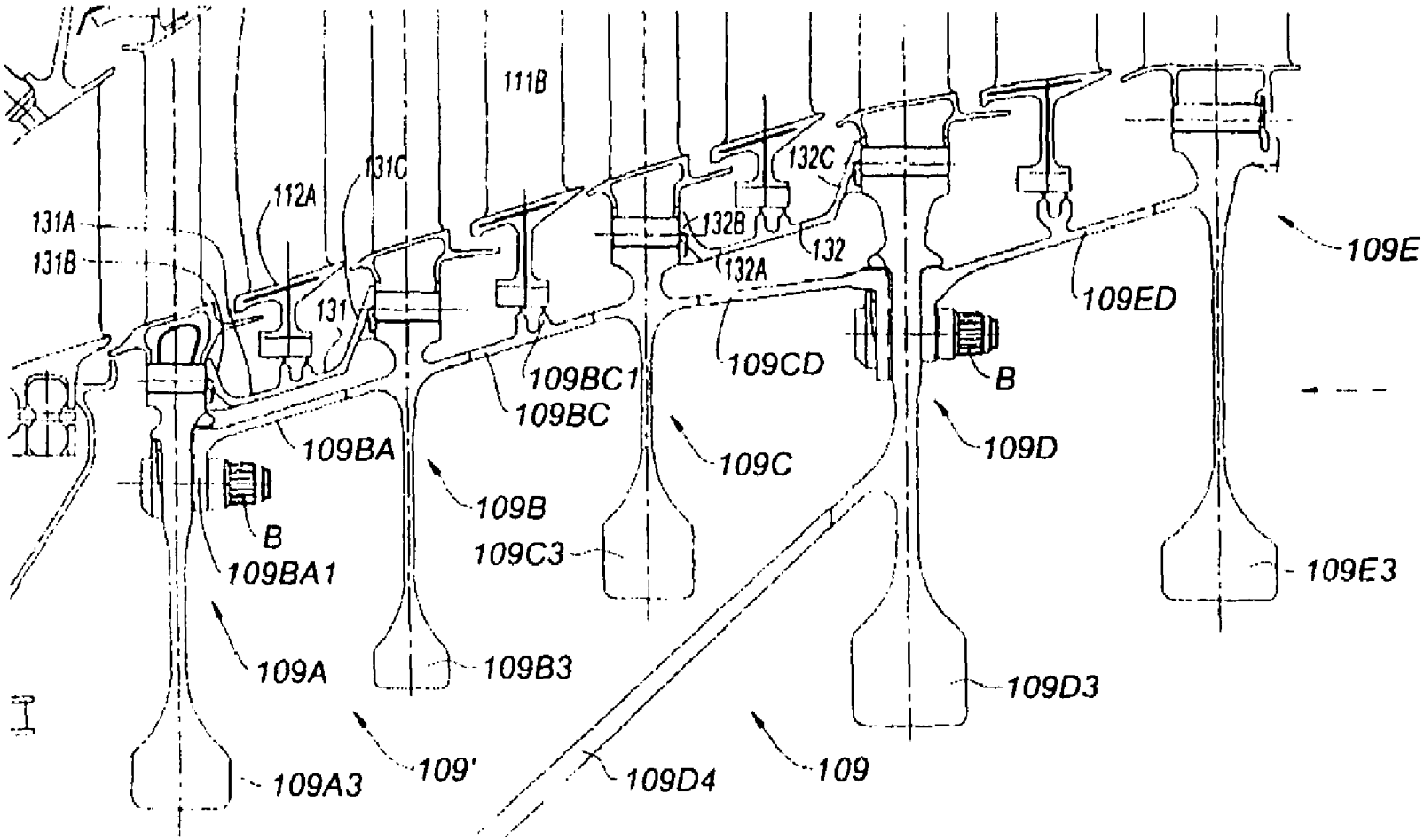
FIG. 4 shows an enlarged part of the rotor of the module of FIG. 2.

Here, the rotary assembly 109 (see also FIG. 4) is composed of five disks, 109B3 to 109E3 on which the mobile blades are mounted. Each blade includes a root in the form of a bulb housed in a socket of complementary shape, with a dovetail profile for example, machined axially in the rim of the disks. The mobile blades and their mounting on a disk are familiar to the professional engineer and do not form part of the invention. The roots include an axial retaining hook, with which we are also familiar.

According to the invention, two disks of the rotor together form a single block 109'. They form a monoblock body, which means that they are not attached by mechanical means such as bolts, and are normally not removable. They are preferably welded. The two disks 109B3 and 109C3 are held together by a ferrule 109BC. The welding zones between the ferrule and the rims of the disks can be seen. This ferrule has two sealing lips 109BC1, oriented transversally in relation to the axis of the engine and formed by machining of the surface facing the distributor 111B. Disk 109B3 is attached to a lateral inter-disk ferrule 109BA. The latter includes a radial bracket 109BA1 by which the rotor is bolted to the adjacent disk 109A3. Only one bolt B is shown. The orifices for the passage of the bolts are drilled in the plane of the disk close to the rim. Disk 109C3 also includes a ferrule 109CD with a radial bracket 109CD1 by which it is bolted (in B) to disk 109D3. Disk 109E3 includes a ferrule 109ED with a radial bracket by which it is bolted to disk 109D3. A cone 109D4 is attached to disk 109D3 for mounting of the rotary assembly on a bearing which is not shown.

In order to provide for the cooling of the blade roots of stages 109B, 109C and 109D, air circuits are created by means of inter-stage rings 131 and 132.

Ring 131 includes a tapered part 131A with a diameter that is slightly greater than that of the ferrule 109BA to form an air passage with the latter. On each side, it has a tapered web 131B and 131C respectively, which rests against the disk 109A3 and 109B3 respectively at the level of the sockets. It thus forms both a means for guiding the air in the latter and an axial end-stop for the blade roots which are housed in them. The air is admitted from the inside of the rotor through passages created between the radial bracket 109BA1 and disk 109A3. It circulates between the two ferrules 109BA and 131A, to be extracted via the sockets of the two disks 109A3 and 109B3 toward the gas channel.

Likewise, ferrule 132 includes a central tapered part 132A edged by two webs 132B and 132C. The cooling air is admitted via passages created between bracket 109CD1 and disk 109D3. It circulates between the ferrules 132A and 109CD from where it is guided to pass through the sockets of disks 109C3 and 109D3, and then into the gas stream.

According to another characteristic of the invention relating to the stator (see also FIG. 3), the external platform 113A forms part of an element 114A in the form of a ring sector, in two parts that are located axially after each other. The said platform is the first part 113A, and a turbine sealing sector that fits together with the tip of the blades of the downstream turbine stage is the second part 113'A. Advantageously the internal platform 112A, element 114A, and the vanes are all formed from a single cast part.

The second part 113'A includes an abradable material 115A facing the sealing lips created at the tip of the blades of the corresponding mobile stage.

Upstream, the external platform 113A includes a pair of axial hooks 113A1 and 113A2 spaced radially in relation to each other. Downstream, it also has a radial support surface 113A3. Downstream, the second part 113'A includes a radial support surface 113'A4, and a radial lug 113'A5 forming an axial end-stop. One can also distinguish an axially-oriented finger 113'A6 which fits between two sectors of the distributor downstream 113B and forms an anti-rotation locking device.

On its inside surface, the casing 120 includes hooks distributed along the axis of the engine, and by which the stators are fixed.

In the figure, one can see an axial hook 121A that includes an outside radial support surface and an inside radial support surface. The spacing between two consecutive hooks 121A and 121B corresponds to the spacing between the hook 113A1 and the radial support surface 113'A4 of a given element 114. The lug 113'A5 rests axially against the hook 121B of the casing.

The pair of stator hooks 113A1 and 113A2 holds the casing hook 121A and the downstream end of the sealing sector 105' which is placed immediately upstream of the distributor stage 111A. For the stator 113B, the pair of hooks holds the assembly composed of the corresponding hook 121, the downstream end of the ring sector 113'A, and the plate 115A of abradable material.

The casing also includes end-stops forming radial support surfaces 122 between two consecutive hooks 121A and 121B. These provide radial support to the support surfaces 113A3.

The blades 109B1 of the stage 109B are terminated by a claw 109B2 which is equipped with sealing lips or radial blades that fit together with the plate in abradable material 115A. They thus form a labyrinth gasket against gas leakages between the two sides of the turbine rotor.

Mounting of the different components of the module is effected in the following manner.

The casing may possibly already be in place on the engine with the ring (105').

The parts are then assembled in the following order.

The complete rotor 109A, whose blades are already mounted on the disk 109A3, is positioned and fixed by means of an appropriate tool.

The distributor 111A is mounted sector by sector by sliding the hooks 113A1 and 113A2 on the downstream part of the assembly formed by the ring 105' and the first hook 121A of the casing. Surface 113A3 rests against the first end-stop 122, and surface 113'A4 rests against the inside radial surface of the second hook 121B. Finger 113'A5 is butted up against the latter.

Inter-stage ring 131 is slid inside ring 111A until it comes up against the rotor 109A, thus axially locking the blade roots in their sockets. Hooks fitted to the root of the blades and bearing against the rim provide immobilisation against all axial movement in one direction. The ring provides axial lock in the opposite direction.

The monoblock body 109' with only the blades of stage 109B is positioned and bolted directly on disk 109A3. It can be seen that the blades of stage 109B rest against the web 131C of the inter-stage ring 131. The hooks on the blade roots are located on the upstream side resting against the rim of the disk, so that the roots are locked against all axial movement.

The distributor 111B is positioned sector by sector. The root of each sector is first introduced between the two disks 109B and 109C, and then the latter is rotated until it latches onto the second hook 121B of the casing, gripping the downstream end of the ring 113'A together with its abradable material. It takes up a position on the casing in the same way as the preceding distributor. The radial downstream finger acts as an axial end-stop against the third hook 121C.

The blades of stage 109C are introduced into their housing on disk 109C3. The hook forming an axial stop element is located on the downstream side of disk 109C3, preventing all axial movement in the upstream direction.

Distributor 111C is mounted so that it adopts a position in the casing like the preceding distributors.

The inter-stage ring 132 is slid into the central passage created by distributor 111C. This rests against disk 109C3, locking the blades.

The complete rotor 109D is bolted onto the bracket 109CD1 of the monoblock 109'.

Distributor 111D is mounted.

The complete rotor 109E is bolted onto disk 109D3.

The above description of the mounting process brings out the advantages of the claimed module structure in relation to that of previous designs, which requires many more operations, in particular because of the larger number of parts to be manipulated.

The description concerns a module comprising five stages. The invention preferably concerns modules composed of four to six stages.

The invention claimed is:

1. A turbine module for a gas-turbine engine with a turbine rotor composed of four disks at least, including a first disk, a second disk adjacent to said first disk, a third disk adjacent to said second disk and a forth disk adjacent to said third disk, said four disks supporting blades on their periphery, said second and third disks forming a monoblock body, wherein said monoblock body includes two lateral inter-disk ferrules, including a first lateral inter-disk ferrule and a second lateral inter-disk ferrule, wherein said first lateral inter-disk ferrule is bolted to said first disk, and said second lateral inter-disk ferrule is bolted to said forth disk.

2. A module according to claim 1, further comprising a first inter-stage ring between said first disk and the monoblock body, and a second inter-stage ring between the monoblock body and said forth disk.

3. A module according to claim 2, wherein said first and second inter-stage rings also form an axial end-stop for the mobile blades.

4. A module according to claim 2, wherein said first and second rings each form a passage for cooling air with said first and second inter-disk ferrules respectively.

5. A turbine module according to claim 1, further comprising at least annular distributors between turbine stages, where said annular distributors include a plurality of elements in the form of a ring sector in which a first part supports fixed blades located radially to the axis of the turbine, and a second part which forms a seal with tips of the turbine rotor blades, and where said elements in the form of a ring sector are held inside a casing by latching devices.

6. A module according to claim 5, further comprising an axial hook attached to the casing or to said element, that engages with a pair of axial hooks attached respectively to said element or the casing.

7. A module according to one of claims 5 and 6, further comprising, on an upstream part of said element, a ring sector.

8. A module according to claim 7, further comprising an axial hook on the casing, which fits together with a pair of axial hooks attached to said element in the form of a ring sector, in such a way that a downstream end of a ring sector for sealing of the rotor placed upstream is held between said axial hooks.

9. A turbine module according to claim 1, wherein said first lateral inter-disk ferrule is welded to said second disk, and said second lateral inter-disk ferrule is welded to said third disk.

10. A turbine module according to claim 9, wherein said monoblock body includes a monoblock ferule between said second and third disks, and wherein said monoblock ferule, said first and second lateral inter-disk ferrules, said second disk and said third disk form a single block welded together.

11. A turbine module according to claim 10, wherein said monoblock ferule includes at least one sealing lip oriented transversally with respect to an axis of said gas-turbine engine and facing a distributor of said gas-turbine engine.

12. A turbine module according to claim 10, wherein said monoblock ferule includes two sealing lips oriented transversally with respect to an axis of said gas-turbine engine and facing a distributor of said gas-turbine engine.

13. A turbine module according to claim 10, wherein said monoblock body includes two welding zones, a first welding zone between said second disk and said monoblock ferule and a second welding zone between said monoblock ferule and said third disk.

14. A turbine module according to claim 13, wherein said monoblock ferule includes two sealing lips oriented transversally with respect to an axis of said gas-turbine engine and facing a distributor of said gas-turbine engine, and wherein said two sealing lips are positioned between said first and second welding zones.

* * * * *